US006793071B2

(12) United States Patent
Rhyne et al.

(10) Patent No.: US 6,793,071 B2
(45) Date of Patent: Sep. 21, 2004

(54) COVER/PAN PACKAGING

(75) Inventors: Edward B. Rhyne, Painted Post, NY (US); Bradley P. Woolaway, Campbell, NY (US)

(73) Assignee: World Kitchen, Inc., Elmira, NY (US)

( * ) Notice: Subject to any disclaimer, the term of this patent is extended or adjusted under 35 U.S.C. 154(b) by 0 days.

(21) Appl. No.: 10/023,209

(22) Filed: Dec. 18, 2001

(65) Prior Publication Data

US 2003/0111364 A1 Jun. 19, 2003

(51) Int. Cl.[7] ..... B65D 75/00
(52) U.S. Cl. ..... 206/223; 206/779; 206/784
(58) Field of Search ..... 206/216, 223, 206/541, 784, 775, 779, 781, 782, 783

(56) References Cited

U.S. PATENT DOCUMENTS

| | | | | |
|---|---|---|---|---|
| 3,608,705 A | | 9/1971 | Moshel | |
| 3,743,170 A | | 7/1973 | Riccio | |
| 3,899,078 A | | 8/1975 | Ambrozetes et al. | |
| 3,990,578 A | | 11/1976 | Roeser | |
| 4,007,285 A | * | 2/1977 | Maier et al. | 426/108 |
| 4,130,237 A | | 12/1978 | Struble | |
| 4,199,058 A | | 4/1980 | Lense et al. | |
| 4,230,260 A | | 10/1980 | Kramer | |
| 4,235,345 A | | 11/1980 | VandeDrink et al. | |
| D260,076 S | | 8/1981 | Schillinger | |
| D261,618 S | | 11/1981 | Oliff et al. | |
| 4,347,930 A | | 9/1982 | Herrin | |
| D267,477 S | | 1/1983 | Graser | |
| 4,407,414 A | * | 10/1983 | Rey et al. | 206/553 |
| 4,549,654 A | | 10/1985 | Tiesman | |
| 4,590,610 A | | 5/1986 | Rhyne | |
| 4,630,734 A | | 12/1986 | Severin et al. | |
| 4,848,541 A | | 7/1989 | Paliotta et al. | |
| 4,948,267 A | | 8/1990 | Kaldenbaugh | |
| D321,480 S | | 11/1991 | Benner | |
| 5,085,316 A | | 2/1992 | Pearce et al. | |
| 5,193,676 A | | 3/1993 | Gold | |
| 5,211,330 A | | 5/1993 | Frey | |
| 5,499,716 A | | 3/1996 | Gardner | |
| 5,520,285 A | | 5/1996 | Mursch et al. | |
| 5,553,706 A | | 9/1996 | Gold | |
| 5,582,345 A | | 12/1996 | Lankhuijzen | |
| 5,598,922 A | | 2/1997 | Good | |
| 5,647,284 A | | 7/1997 | Frysinger et al. | |
| 5,715,993 A | | 2/1998 | Pareike | |

(List continued on next page.)

FOREIGN PATENT DOCUMENTS

| | | | |
|---|---|---|---|
| FR | 2619793 | * | 6/1987 |
| FR | 2822443 | * | 3/2001 |

OTHER PUBLICATIONS

Revere®, Centura™ Skillet Cover Packaging, 1999.

*Primary Examiner*—Jacob K. Ackun, Jr.
(74) *Attorney, Agent, or Firm*—Wolf, Greenfield & Sacks, P.C.

(57) ABSTRACT

Packaging is provided for removably holding a pan and cover together. The packaging includes a sheet provided with a top and bottom panel and adapted to accommodate a cover of a pan between the top and bottom panels when expanded to form a loop. The top panel may define a first hole adapted to receive a cover handle. A portion of the sheet defines a second hole adapted to receive a handle of a pan. When the cover is inserted in the loop and the handle of a pan is inserted through the second hole, the cover is removably secured to the pan such that it can lie over an opening of the pan, yet be moved to view the inside of the pan thereby allowing a prospective buyer to inspect the interior of the pan. In the preferred embodiment, a rectangular sheet with two opposed ends secured together forms the packaging. The second hole, adapted to receive a handle of a pan, is provided adjacent the secured opposed ends.

38 Claims, 4 Drawing Sheets

U.S. PATENT DOCUMENTS

| | | | |
|---|---|---|---|
| 5,728,440 | A | 3/1998 | Good |
| 5,735,423 | A | 4/1998 | Black |
| 5,738,218 | A | 4/1998 | Gonzales |
| 5,927,496 | A | 7/1999 | Seaton et al. |
| 5,950,838 | A | 9/1999 | Fletcher et al. |
| D417,149 | S | 11/1999 | Fletcher et al. |
| 6,015,043 | A | 1/2000 | Sandberg et al. |
| 6,050,416 | A | 4/2000 | Blin et al. |
| 6,079,561 | A | 6/2000 | Burkand |
| 6,145,659 | A | 11/2000 | Faircloth et al. |
| D437,780 | S | 2/2001 | Fletcher et al. |
| D438,466 | S | 3/2001 | Fletcher et al. |
| 6,209,763 | B1 | 4/2001 | Rahmey |

* cited by examiner

COVER/PAN PACKAGING

BACKGROUND OF THE INVENTION

In the field of cookware, when selling pans with covers, it is desirable to display them together, so that a prospective buyer may examine both pieces. This gives prospective buyers the opportunity to examine each piece thoroughly before deciding whether to purchase the set. However, if the two pieces are not attached to one another, then they may become separated. Once separated, it may be difficult to match a pan with its corresponding cover. Resulting mismatched pans and covers may be difficult, if not impossible, to sell. The construction of pans and covers makes it difficult to conveniently attach them together while allowing each piece to be thoroughly examined by a prospective buyer.

Different methods have been developed to keep a pan and its cover together as a set. One such method is to box the pan and cover together. In this manner, the two pieces are secured together in a closed box. Multiple and/or differently sized pans and covers may be stored in one box. The boxes are usually opaque and made of cardboard. A picture or photo of the pan and cover set is often provided on the outside of the box. This method allows for easy shipment of pans and covers, as they are readily provided in a convenient size and shape to stock and store—namely a box or cube shape. However, because the pan and cover are in the box, the prospective buyer can no longer see and hold the set before purchasing. In order for the prospective buyer to do so, a sample pan and cover set must be removed from a box.

In another manner, the cover may be shrink-wrapped to the pan. Typically, the pan and cover are shrink-wrapped with a flexible, but strong and clear plastic material. The prospective buyer is able to see the outside of the pan and cover, but cannot look at the inside surface of the pan or cover. Inevitably, no matter the location of the cover vis-à-vis the pan, at least a portion of the pan and the cover will not be visible. This prevents a prospective buyer from being able to inspect all surfaces of the pan and cover.

Packaging for displaying covers, sold separately from a pan, enabling it to be sold on a hook is known. The packaging includes a rectangular piece of folding board with two opposed ends secured together to form a loop. The loop accommodates a cover between top and bottom portions of the loop. The top portion of the loop includes a circular opening to accommodate a handle of the cover. Adjacent the secured area, a small round or key-slot shaped hole is defined to accommodate a hook. The cover is removably provided within the loop of the packaging and hung from a display hook in a store. This packaging provides a convenient way to display covers, as covers do not readily lend themselves to stacking or hanging.

SUMMARY OF THE INVENTION

According to the invention, packaging for holding a pan and a cover together is disclosed. In one illustrative embodiment of the invention, the packaging includes an elongated sheet having a first part of the sheet secured to a second part of the sheet. A first panel and a second panel are provided between the secured first and second parts of the sheet and adapted to be spaced from one another to form a loop to accommodate a cover of a pan therebetween. A first hole located in the first panel adapted to receive a handle of a cover and a second hole located in a portion of the sheet and adapted to receive a handle of a pan.

The first hole may be substantially centered on the first panel. In one illustrative embodiment, the first hole is substantially round. At least one flap may be provided extending from a perimeter of the first hole. The flaps may be formed substantially surrounding a perimeter of the first hole.

In one illustrative embodiment, the portion of the sheet is a separate piece attached to the sheet. For example, the portion may be attached to the sheet with adhesive. Additionally, the sheet may have two opposed ends, wherein the two opposed ends may be the secured first and second parts of the sheet. In one embodiment, the second hole is formed from two aligned holes one provided adjacent each opposed end of the sheet. The second hole may be defined by the secured opposed ends forming the portion of the sheet. The second hole may be provided adjacent the secured opposed ends.

In another illustrative embodiment, the packaging may have a first surface, a second surface and two opposed ends of the sheet, with the secured parts of the sheet including the first opposed end secured at a point on the first surface and removed from the second opposed end. The first end may have a top and bottom surface and the top surface of the first end is secured to the first surface to form the loop. The first end may have a top and bottom surface and the bottom surface of the first end is secured to the first surface to form the loop. In one embodiment, the second hole is provided on the portion of the sheet between the second end of the sheet and the first and second panels. In one embodiment, the sheet is substantially rectangular.

The sheet may have two opposed ends, wherein the second hole is provided adjacent at least one end of the sheet. The first and second parts may be affixed to each other with adhesive. The first and second parts may be affixed to each other with at least one staple. At least one flap may be provided adjacent a perimeter of the second hole. The second hole may be substantially rectangular. Two flaps may be provided on opposite sides of the rectangular second hole. At least one fold may be provided between the first panel and the second panel of the sheet. In one embodiment, the packaging includes at least four folds provided on the sheet. At least one fold may be provided on the sheet between the first and second parts of the sheet. The first panel of the sheet may be longer than the second panel of the sheet.

In another illustrative embodiment, packaging for holding a pan and a cover together is disclosed. The packaging comprises a sheet having a first part secured to a second part and a first panel and a second panel provided between secured first and second parts of the sheet and adapted to be spaced from one another to form a loop to accommodate a cover of a pan therebetween. A hole located in a portion of the sheet and adapted to receive a handle of a pan.

In one embodiment, the portion of the sheet is a separate piece attached to the sheet. In another embodiment, sheet is formed of multiple pieces. The sheet may have two opposed ends, and the two opposed ends may be the secured first and second parts of the sheet. The hole may be defined by the two secured opposed ends forming the portion of the sheet. The hole may be provided adjacent the secured opposed ends. The hole may be substantially rectangular. At least one fold may be provided between the first panel and second panel of the sheet. In one embodiment, at least four folds are provided on the sheet. A second hole may be provided on the first panel of the sheet for accommodating a cover handle of a cover.

In another illustrative embodiment, a method of removably holding a pan and cover together is disclosed. The method comprises the steps of providing a packaging having a sheet with a portion having a hole and a first part secured to a second part, expanding the packaging to form a loop, inserting a cover of a pan within the loop and inserting a handle of a pan within the hole provided on the portion of the sheet, such that the cover is removably secured to the pan.

BRIEF DESCRIPTION OF THE DRAWINGS

Other features and advantages of the invention will become apparent from the following detailed description taken in conjunction with the accompanying drawings, in which.

DETAILED DESCRIPTION

The invention relates to packaging for use to removably secure a pan and cover together for display and storage. The packaging of the invention may be used with various types of pans, pots, containers and other cooking vessels that include a cover. Even oddly-shaped storage containers or boxes with one or more handles and having covers may be used with the present invention. Although any type of pan, pot or container may be used with the invention, the invention will be described with respect to a pan as shown in FIGS. 1 and 2.

Figure 1:
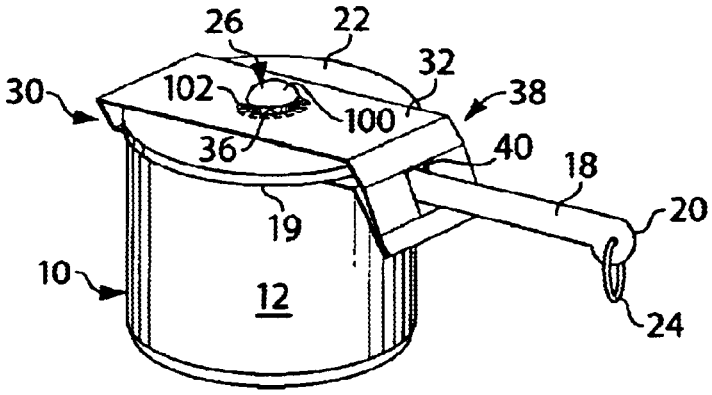
FIG. 1 is a perspective view of cover/pan packaging according to the invention in use with a pan and cover set.
Figure 2:
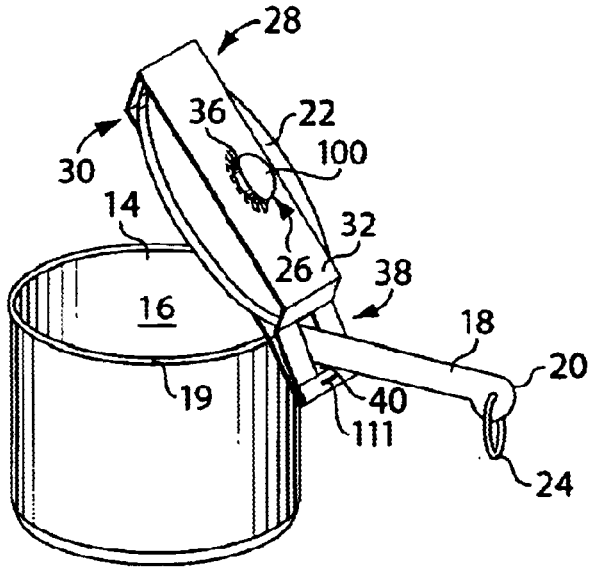
FIG. 2 is a perspective view of the cover/pan packaging according to the invention in use with a pan and cover set, with the cover lifted up and away from an opening of the pan.

As shown in FIGS. 1 and 2, a pan 10 that may be packaged by the present invention has a cylindrical exterior 12, with an opening 14 providing access to an internal space 16 used to house and/or cook foods. The exterior 12 of the pan 10 generally includes a handle 18 extending away from an upper lip 19 of the pan 10 and having a free end 20 such that it may be gripped by the user to move the pan 10, alone or with a cover 22, without the user having to touch the pan 10 itself.

The pan 10 capable of use with the invention may be made in any desired shape such as cylindrical, oval, square or rectangular. The handle 18 of the pan 10 may also take on numerous different shapes and configurations. One such configuration is shown in FIGS. 1 and 2, although other configurations may be used. For example, the handle may be a shorter, stouter handle than that shown as is usually provided on storage containers. The handle may include a ring 24 or hole (not shown) adjacent the free end 20 used to hang the pan 10 on a hook (not shown) typically provided on a pot display rack or in a store, as is well known to those of skill in the art.

The cover 22, when placed on the pan 10, shields the opening 14 of the pan 10 and may include a cover handle 26, such that the cover handle 26 may be grasped to move the cover 22. One such typical cover 22 is shown in FIGS. 1 and 2. It will be understood that the cover 22 may have any desired shape so long as it corresponds with and substantially closes the opening 14 of the pan 10 when placed thereon. Moreover, the cover handle 26 may also have any desired shape so long as it may be grasped by a user to move the cover 22.

Referring to FIGS. 1 and 2, an exemplary embodiment of packaging 28 of the invention is shown and is used to store and display the pan 10 and cover 22 removably attached to one another. For example, the packaging 28 allows the pan 10 to be hung from a hook (not shown) by the ring 24 or hole (not shown) on the free end 20 of the handle 18 and still keep the cover 22 removably secured to the pan 10. Thus, the pan 10 and cover 22 combination may be easily displayed to prospective buyers in stores. Additionally, the cover 22 may be moved away or flipped up from the opening 14 of the pan 10 such that the inside of the pan 10 may be inspected by a prospective buyer. Thus, the packaging 28 provides a convenient manner of displaying the products together, yet allows both pieces to be thoroughly inspected by a prospective buyer by removal from one another, without completely separating the pieces.

Figure 3:
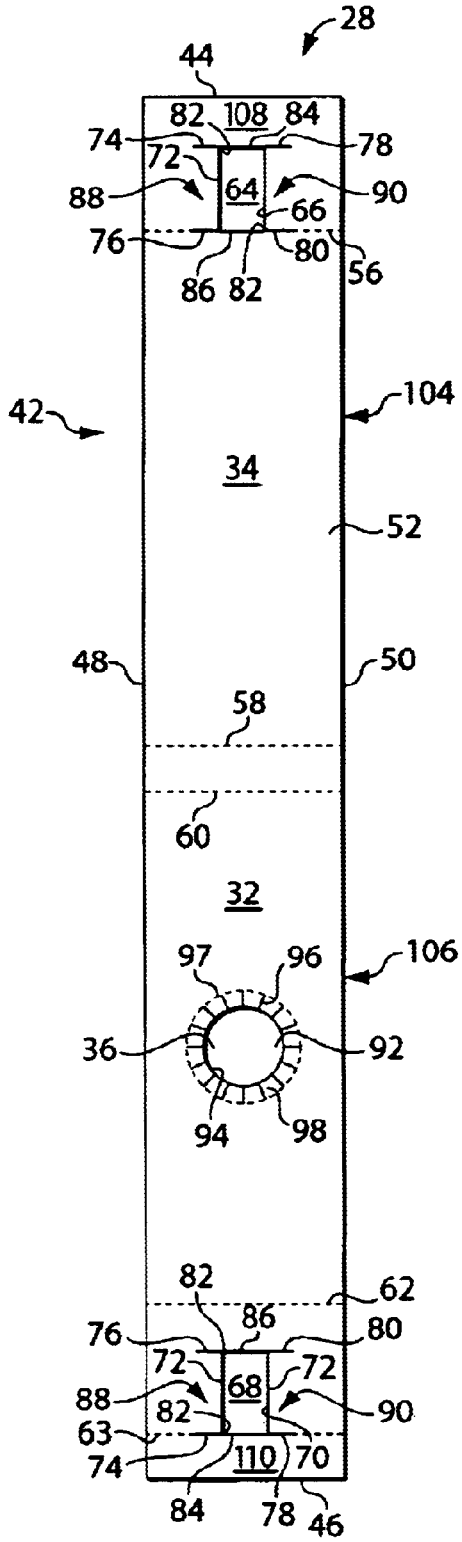
FIG. 3 is a bottom view of the preferred embodiment of the unfolded sheet forming the cover/pan packaging of the invention prior to securing opposed ends of the sheet together.
Figure 6:
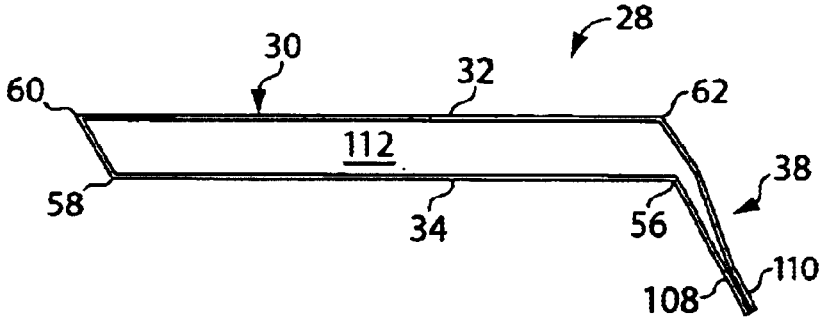
FIG. 6 is a side view of the folded and expanded cover/pan packaging of FIG. 3.
Figure 7:
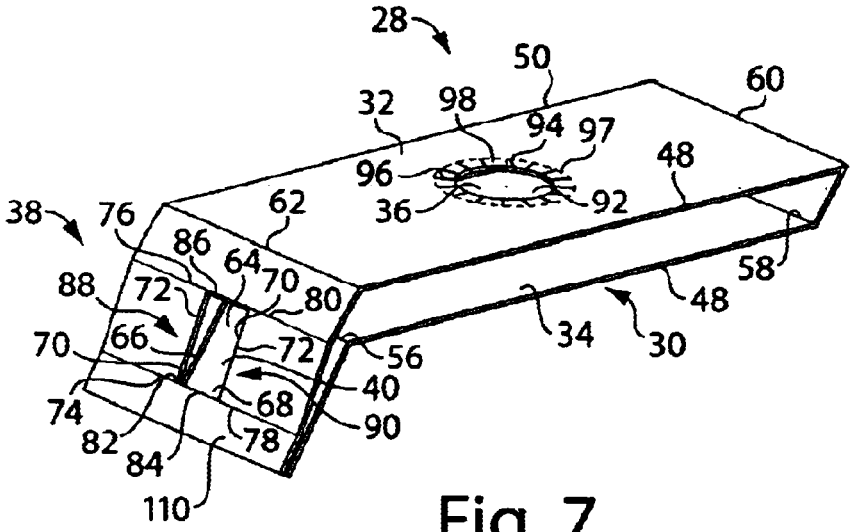
FIG. 7 is perspective view of the folded and expanded cover/pan packaging of FIG. 3.

In the illustrative exemplary embodiment, the packaging 28 includes a sheet 42 with folds, and two holes. It will be appreciated, however, that the packaging 28 may be made of multiple sheets secured together and may or may not have folds. When the sheet 42 shown in FIG. 3 is folded and the ends are secured together, it may be expanded to form a loop 30 (FIGS. 6 and 7). In the expanded position, top panel 32 and a bottom panel 34 are spaced from one another and are adapted to accommodate a cover 22 therebetween. Provision of a cover handle hole 36 in the top panel 32 to accommodate the cover handle 26 through the cover handle hole 36 assists in keeping the cover 22 within the loop 30 of the sheet 42. A portion 38 of the sheet extends from the loop 30 and defines a pan handle hole 40 adapted to receive a handle 18 of a pan 10. Thus, a cover 22 may be removably secured to a pan 10 adjacent an opening 14 of the pan 10 and allow inspection of the internal space 16 of the pan 10. The portion 38 of the sheet 42 may be formed from the sheet 42 as shown, or may be a separate piece attached to the sheet 42, such as with adhesive.

Figure 4:
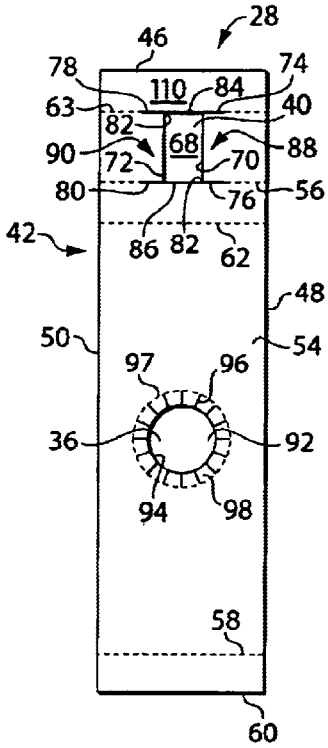
FIG. 4 is a top view of the folded and unexpanded cover/pan packaging of FIG. 3 after the ends are secured together.
Figure 5:
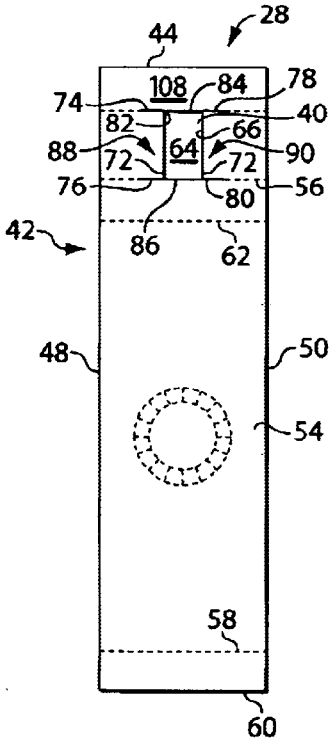
FIG. 5 is a bottom view of the folded and unexpanded cover/pan packaging of FIG. 3 after the ends are secured together.

Referring to FIGS. 3–7, an exemplary embodiment of the packaging 28 is shown. As shown in FIG. 3, the unfolded packaging 28 includes the elongated sheet 42 of material. The sheet 42 is substantially rectangular in shape. The sheet 42 features first and second opposed ends 44 and 46 and first and second sides 48 and 50 connecting the opposed ends 44 and 46. The sheet 42 has two surfaces, an inside surface 52 (FIG. 3) and an outside surface 54 (FIGS. 4 and 5). As shown, the sheet 42 features first, second, third and fourth folds 56, 58, 60 and 62 provided substantially parallel to the first and second ends 44 and 46 of the sheet 42 and substantially perpendicular to the first and second sides 48 and 50 of the sheet 42. An optional fifth fold 63 may be provided adjacent the second end 46. It will be appreciated that the sheet 42 may feature one or more folds, or even no folds. Bottom panel 34 is located between the first and second folds 56 and 58 and top panel 32 is located between the third and fourth folds 60 and 62. It will also be appreciated that the sheet 42 may be made in any suitable shape, not just rectangular. Preferably, the sheet 42 is formed of folding board, although any suitable material such as cardboard may be used to form the packaging 28. Additionally, any suitable thickness for the material may be used. For example, it may be desirable to use a thicker material on packaging 28 for larger pot and cover sets.

The elongated sheet 42 of FIG. 3 is shown folded at third fold 60 in FIGS. 4 and 5. FIG. 4 shows the top of the folded elongated sheet 42 including the top panel 32, while FIG. 5 shows the bottom of the folded elongated sheet 42 including the bottom panel 34. As shown, the pan handle hole 40 of the packaging 28 may be formed from two substantially aligned holes when the elongated sheet 42 is folded. Referring to FIG. 3, a first hole 64 defined by a first edge 66 is provided adjacent the first end 44 of the sheet 42 and a second hole 68 defined by a second edge 70 is provided adjacent the second end 46 of the sheet 42. As shown, the first and second holes 64 and 68 correspond with each other and are aligned when the elongated sheet 42 is folded at third fold 60 as shown in FIGS. 4 and 5. The first and second holes 64 and 68 are rectangular with the longer sides 72 of the rectangular holes parallel to the first and second sides 48 and 50 of the sheet 42. It will be appreciated, however, that the first and second holes may be of any suitable size or shape for accommodating any handle of any pan through and retaining in the holes 64 and 68. Additionally, the first and second holes may be provided at any suitable location on the sheet 42 for accommodating the handle 18 of the pan 10. For example, it may be desirable to provide the holes 64 and 68 on either side of fold 60. In the preferred embodiment shown in FIG. 3, the first and second holes 64 and 68 are substantially centered between the first and second sides 48 and 50 of the sheet 42.

Each hole 64 and 68 may additionally include slits 74, 76, 78 and 80 extending from the edge or perimeter 66 and 70 defining the hole 64 and 68 and into the material of the sheet 42. Preferably, the slits 74, 76, 78 and 80 are cut in the sheet 42 such that they extend all of the way through the material from the inside surface 52 to the outside surface 54. As shown, preferably four slits 74, 76, 78 and 80 are provided, one extending from each corner 82 of the rectangular holes 64 and 68 and extending substantially aligned with and parallel to the ends 84 and 86 of the rectangular holes 64 and 68. The first and second slits 74 and 76 form a first flap 88 and the third and fourth slits 78 and 80 form a second flap 90. When the sheet 42 is folded at third fold 60, both the holes 64 and 68 and flaps 88 and 90 are substantially aligned. The slits 74, 76, 78 and 80 provided on the first and second holes 64 and 68 allow the holes to accommodate differently shaped and sized handles 18 because the holes may be temporarily expanded by movement of the flaps 88 and 90 formed by the slits 74, 76, 78 and 80 during insertion and removal of a handle. It will be appreciated that the slits may be any desired length and shape, for example the slits may be all the same length or they may be different lengths. Use of the slits around the holes 40, 64 and 68 may prevent the material from inadvertently tearing by more easily accommodating differently sized and shaped handles. Additionally, the slits may allow the handle to be more stably held within the holes 40, 64 and 68. This is accomplished because the slits 74, 76, 78 and 80 allow expansion of the holes 40, 64 and 68 by movement of the flaps 88 and 90 to accommodate the handle 18, and the flaps 88 and 90 return to their original position after insertion of the handle 18 to assist in stably holding the handle 18 within the holes.

Referring to FIG. 3, a third hole 92 defined by a third edge 94 may be provided in the sheet 42 to accommodate the cover handle 26. As shown, the third hole 92 is preferably provided on the top panel 32 between the third and fourth folds 60 and 62 of the sheet 42 to accommodate a cover handle. Although, the third hole 92 may be provided at any suitable location on the sheet 42 to accommodate a cover handle. Provision of the third hole 92 to accommodate the cover handle 26 assists in keeping the cover 22 within the loop 30 of the expanded packaging 28. The third hole 92 may be any shape to accommodate any type of cover handle 26. For example, the third hole may be substantially rectangularly shaped to accommodate a cover handle having a rectangular cross-sectional shape such as a bar (not shown). The bar may be attached to the cover at opposite ends of the bar or in the middle of the bar. As shown, preferably the third hole 92 is substantially round. The third hole 92 may be centered between either or both the third and fourth folds 60 and 62 and the first and second sides 48 and 50 of the sheet 42.

Slits 96 may be provided extending from the third edge or perimeter 94 defining the third hole 92. As shown, preferably multiple slits 96 extend from the edge 94 of the third hole 92. Outer ends 97 of the slits 96 define a circular area, within which the third hole 92 resides. Preferably, the slits 96 are cuts in the sheet 42 and extend completely through the material from the inside surface 52 to the outside surface 54. The slits 96 are preferably substantially straight. It will be understood that the slits 96 may have any desired length and shape, and the slits 96 may all be the same length or each or some may be of different lengths. As shown, the slits 96 extend perpendicular to the edge 94 of the third hole 92, however they may be provided at any desired angle.

The slits 96 extending from the third hole 92 assist in accommodating differently shaped and sized cover handles 26 within the third hole 92 by forming movable flaps 98 between the slits 96. For example, if the top 100 (FIG. 1) of the cover handle 26 is larger than its base or neck 102 (FIG. 1), the movable flaps 98 formed by the slits 96 may temporarily expand the hole 92 to allow the top 100 of the cover handle 26 to be inserted through the third hole 92, yet prevent the cover handle 26 from being easily pulled out of the third hole 92, by stably holding the cover handle 26 within the hole 92 when the flaps return to their original position after insertion of the cover handle 26.

As shown in FIGS. 4 and 5, the sheet is folded in half at the third fold 60 to form an unexpanded loop 30 such that two portions 104 and 106 of the inside surface 52 (FIG. 3) mate against one another. In the preferred embodiment, the first and second ends 44 and 46 are aligned with one another and the first and second holes 64 and 68 are also aligned with one another as they are substantially the same size and shape. End portions 108 and 110 of the inside surface 52 of the sheet 42 are secured together such that the first and second holes 64 and 68 mate with one another. The end portions 108 and 110 are preferably secured using adhesive, although any suitable manner of securing the end portions 108 and 110 together may be used, such as staples 111 (FIG. 2). As shown, the portion of the end portions 108 and 110 secured together may not include the first and second holes 64 and 68. For example, if the fifth fold 63 is provided, the end portions 108 and 110 may be secured up to the fifth fold, thereby not including the first and second holes 64 and 68.

Alternatively, the end portions 108 and 110 secured together may include a part or all of the sheet 42 up to the first fold 56, including part or all of the first and second holes 64 and 68. It is contemplated that the outside surface 54 of one end portion could be secured to the inside surface 52 of the other end portion. Of course, portions of the outside surface 54 may also be secured against one another. It will also be appreciated that the first and second ends 44 and 46 of the sheet 42 do not need to mate and align with one another. Additionally, it will be understood that only one hole may be provided to form the pan handle hole 40. In this case, either surface of one end portion 108 and 110 is secured to either the inside or outside surface 52 and 54 of the sheet 42 adjacent the one pan handle hole 40, such that the hole is exposed for use. It will also be appreciated that the portion 38 of the sheet 42 including the pan handle holes 40, 64 and 68 may be formed as a separate piece, with the separate piece being attached to the sheet 42 forming the loop 30 as described above.

Referring to FIGS. 6 and 7, the preferred embodiment of the packaging 28 is shown expanded to receive a cover 22 of a pan 10. The top panel 32 and bottom panel 34 of the loop 30 form a space 112 therebetween for accommodating a cover 22 of a pan 10. The cover 22 may be inserted in the space 112 between the top and bottom panels 32 and 34 of the loop 30, and the cover handle 26 may be inserted through the third hole 92 provided in the top panel 32 of the loop 30 formed from the sheet 42. As shown, the top and bottom panels 32 and 34 of the sheet 42 are substantially equal in length. It will be understood that the top panel 32 and bottom panel 34 of the sheet 42 may be different lengths to accommodate differently shaped covers. If the pan 10 features a ring 24 (FIG. 1) or hole (not shown) on the free end 20 of the handle 18, the pan 10 and cover 22 may be hung from a hook (not shown) by the ring 24 or hole to display the pan and cover set together.

The packaging 28 may be made by any suitable manner known to those of skill in the art. For example, folding board may be printed on the outside surface 54 with the desired logos and other pertinent information regarding the product. The folding board may then be cut into sheets 42, the holes 36, 40, 64, 68 and 92 and slits 74, 76, 78, 80 and 96 cut into the sheets 42, and folds 56, 58, 60 and 62 formed in the sheets 42. The sheets are then folded at third fold 60 and end portions 108 and 110 of the sheets 42 are thereafter glued together to form the unexpanded packaging 28. The packaging 28 may then be used to store and display pan and cover sets by expanding the packaging to form the loop 30. It will be appreciated that the cover may be inserted either prior to folding or prior to securing the end portions of the sheet, instead of after the packaging is formed.

From the foregoing description, those skilled in the art will appreciate that numerous modifications may be made of this invention without departing from its spirit. For example, only one hole may be provided in the sheet for receiving the handle of the pan, with the end of the sheet without the second hole being secured below the first hole. Therefore, the breath of the invention is not to be limited to the specific embodiments illustrated and/or described. Numerous modifications will occur to those skilled in the art, and therefore, the scope of the invention is to be determined by the appended claims and their equivalents.

What is claimed is:

1. Packaging for holding a pan and a cover together, the packaging comprising:

an elongated sheet having a first part of the sheet secured to a second part of the sheet;

a first panel and a second panel provided between the secured first and second parts of the sheet and adapted to be spaced from one another to form a loop having a loop opening to accommodate a cover of a pan therebetween;

a first hole located in the first panel adapted to receive a handle of a cover; and a second hole located in a portion of the sheet and adapted to receive a handle of a pan; wherein a length of the loop opening is greater than a width of the elongated sheet.

2. The packaging of claim 1, wherein the first hole is substantially centered on the first panel.

3. The packaging of claim 1, wherein the first hole is substantially round.

4. The packaging of claim 1, further comprising at least one flap extending from a perimeter of the first hole.

5. The packaging of claim 1, further comprising flaps formed substantially surrounding a perimeter of the first hole.

6. The packaging of claim 1, wherein the portion of the sheet is a separate piece attached to the sheet.

7. The packaging of claim 6, wherein the portion is attached to the sheet with adhesive.

8. The packaging of claim 1, further comprising two opposed ends of the sheet, wherein the two opposed ends are the secured first and second parts of the sheet.

9. The packaging of claim 8, wherein the second hole is formed from two aligned holes one provided adjacent each opposed end of the sheet.

10. The packaging of claim 8, wherein the second hole is defined by the secured opposed ends forming the portion of the sheet.

11. The packaging of claim 8, wherein the second hole is provided adjacent the secured opposed ends.

12. The packaging of claim 1, further comprising a first surface, a second surface and two opposed ends of the sheet, with the secured parts of the sheet including the first opposed end secured at a point on the first surface and removed from the second opposed end.

13. The packaging of claim 12, wherein the first end has a top and bottom surface and the top surface of the first end is secured to the first surface to form the loop.

14. The packaging of claim 12, wherein the first end has a top and bottom surface and the bottom surface of the first end is secured to the first surface to form the loop.

15. The packaging of claim 12, wherein the second hole is provided on the portion of the sheet between the second end of the sheet and the first and second panels.

16. The packaging of claim 1, wherein the sheet is substantially rectangular.

17. The packaging of claim 1, further comprising two opposed ends of the sheet, wherein the second hole is provided adjacent at least one end of the sheet.

18. The packaging of claim 1, wherein the first and second parts are affixed to each other with adhesive.

19. The packaging of claim 1, wherein the first and second parts are affixed to each other with at least one staple.

20. The packaging of claim 1, further comprising at least one flap provided adjacent a perimeter of the second hole.

21. The packaging of claim 1, wherein the second hole is substantially rectangular.

22. The packaging of claim 21, further comprising two flaps provided on opposite sides of the rectangular second hole.

23. The packaging of claim 1, further comprising at least one fold provided between the first panel and the second panel of the sheet.

24. The packaging of claim 1, further comprising:

at least four folds provided on the sheet.

25. The packaging of claim 24, wherein at least one fold is provided on the sheet between the first and second parts of the sheet.

26. The packaging of claim 1, wherein the first panel of the sheet is longer than the second panel of the sheet.

27. Packaging for holding a pan and a cover of the pan together, in combination with the cover of the pan, the combination comprising:

a cover of a pan;

a sheet having:

a first part secured to a second part;

a first panel and a second panel provided between secured first and second parts of the sheet and adapted to be spaced from one another to form a loop to accommodate the cover of the pan therebetween; and a hole located in a portion of the sheet and adapted to receive a handle of the pan.

28. The combination of claim 27, wherein the portion of the sheet is a separate piece attached to the sheet.

29. The combination of claim 27, wherein sheet is formed of multiple pieces.

30. The combination of claim 27, wherein the sheet has two opposed ends, and the two opposed ends are the secured first and second parts of the sheet.

31. The combination of claim 30, wherein the hole is defined by the two secured opposed ends forming the portion of the sheet.

32. The combination of claim 30, wherein the hole is provided adjacent the secured opposed ends.

33. The combination of claim 27 wherein the hole is substantially rectangular.

34. The combination of claim 27, further comprising:

at least one fold provided between the first panel and second panel of the sheet.

35. The combination of claim 27, further comprising:

at least four folds provided on the sheet.

36. The combination of claim 27, further comprising:

a second hole provided on the first panel of the sheet for accommodating a cover handle of the cover.

37. A method of removably holding a pan and cover together, the method comprising the steps of:

providing a packaging having a sheet with a portion having a hole and a first part secured to a second part;

expanding the packaging to form a loop;

inserting a cover of a pan within the loop;

inserting a handle of a pan within the hole provided on the portion of the sheet, such that the cover is removably secured to the pan.

38. Packaging for holding a pan and a cover together, the packaging comprising:

an elongated sheet having a first part of the sheet secured to a second part of the sheet, and further having two opposed ends of the elongated sheet;

a first panel and a second panel provided between the secured first and second parts of the sheet and adapted to be spaced from one another to form a loop to accommodate a cover of a pan therebetween;

a first hole located in the first panel adapted to receive a handle of a cover; and a second hole located in a portion of the sheet and adapted to receive a handle of a pan; wherein the second hole is provided by two at least partially overlapping holes, one hole present in each of the two opposed ends of the elongated sheet.

* * * * *